US008281509B2

(12) United States Patent
Perez

(10) Patent No.: US 8,281,509 B2
(45) Date of Patent: Oct. 9, 2012

(54) NAUTICAL NAVIGATION AID WITH A PHOTOLUMINESCENT ELEMENT AND A LIGHT WAVE RE-DIRECTING MEANS FOR IMPROVED PHOTOLUMINESCENCE

(76) Inventor: Edwin Perez, Davie, FL (US)

( * ) Notice: Subject to any disclaimer, the term of this patent is extended or adjusted under 35 U.S.C. 154(b) by 116 days.

(21) Appl. No.: 12/854,442

(22) Filed: Aug. 11, 2010

(65) Prior Publication Data

US 2012/0036749 A1 Feb. 16, 2012

(51) Int. Cl.

| | |
|---|---|
| ***G09F 13/20*** | (2006.01) |
| ***G09F 13/00*** | (2006.01) |
| ***G09F 13/16*** | (2006.01) |
| ***G09F 7/00*** | (2006.01) |
| ***G09F 19/00*** | (2006.01) |
| ***E01F 9/00*** | (2006.01) |
| ***E01F 9/06*** | (2006.01) |
| ***E01F 9/08*** | (2006.01) |

(52) U.S. Cl. ..... 40/542; 40/565; 40/554; 40/556; 40/557; 40/582; 40/612; 40/615; 40/903; 404/9; 404/13; 404/14; 404/15; 404/16

(58) Field of Classification Search ..... 40/542, 40/565, 554, 557, 556, 582, 612, 615, 900; 414/13, 15, 14, 9, 16

See application file for complete search history.

(56) References Cited

U.S. PATENT DOCUMENTS

| | | | | |
|---|---|---|---|---|
| 5,243,457 | A | 9/1993 | Spencer | |
| 5,816,737 | A * | 10/1998 | Siblik | 404/13 |
| 6,158,379 | A * | 12/2000 | Burlando | 116/63 R |
| 6,488,441 | B1 * | 12/2002 | Solime' | 404/42 |
| 6,651,014 | B2 * | 11/2003 | Chandra et al. | 702/65 |
| 6,656,566 | B1 | 12/2003 | Kuykendall et al. | |
| 7,018,131 | B2 * | 3/2006 | Jordan | 404/16 |
| 7,587,845 | B1 | 9/2009 | Perez | |
| 2001/0048847 | A1 * | 12/2001 | Khieu et al. | 404/16 |
| 2008/0305310 | A1 * | 12/2008 | Hausserman et al. | 428/195.1 |

* cited by examiner

*Primary Examiner* — Tashiana Adams
*Assistant Examiner* — Syed A Islam
(74) *Attorney, Agent, or Firm* — Ruben Alcoba, Esq; Craig Kirsch, Esq

(57) ABSTRACT

A nautical navigation aid comprising a photoluminescent element and a light wave re-directing means for improved photoluminescent qualities used to enhance the safety of nautical travelers on waterways in conditions where visibility is limited. The navigation aid sign has a first rigid sheet member having an upper surface, a lower surface and a peripheral edge, a second rigid sheet member having an upper surface and a lower surface extending outward from the peripheral edge of the first rigid sheet member at a predetermined angle to a predetermined length, thereby defining an angled collar of the first rigid sheet member sized and configured to redirect light waves emanating from a light source, and a luminescent layer. It is envisioned that an embodiment of the present invention might also include a means for retrofitting existing nautical navigation aids with a photoluminescent element and a light wave re-directing means for improved photoluminescent qualities.

16 Claims, 3 Drawing Sheets

NAUTICAL NAVIGATION AID WITH A PHOTOLUMINESCENT ELEMENT AND A LIGHT WAVE RE-DIRECTING MEANS FOR IMPROVED PHOTOLUMINESCENCE

BACKGROUND

The present invention is a nautical navigation aid with both photoluminescent and enhanced light trapping qualities that is used to enhance the safety of nautical travelers on waterways in conditions where visibility is limited.

The inventor conceived the present invention while on duty as a vessel operator with the United States Customs and Border Protection. As a vessel operator with the United States Customs and Border Protection, the inventor has spent countless hours navigating various waterways during a myriad of weather conditions and particularly the inventor has navigated waterways throughout the spectrum of visible light associated with the different locales, seasons, and time of day of the waterways of the United States and its territories.

In order for nautical travelers to safely navigate the waterways of the United States and its territories, a system known as the U.S. Aids to Navigation System has been employed by the United States Coast Guard. This system comprises a simple arrangement of colors, shapes, numbers, and light characteristics to mark navigable channels, waterways, as well as the known obstructions in the bodies of water. This system can provide a nautical traveler with the same type of information an automobile driver obtains from street signs, stop signals, road barriers, detour signs and traffic signals.

After more than 20 years of navigating various waterways, as a vessel operator with the United States Customs and Border Protection, the inventor has observed that the existing aids to navigation, specifically the Daybeacon (a non-lighted nautical sign permanently affixed to the earth's surface), is effective in ideal conditions, i.e. sunny, dry, conditions with good visibility, but is less effective in conditions with limited visibility, namely foggy conditions or other conditions where there is limited daylight.

A navigation aid that cannot be seen is as effective as not having an aid, for it does not convey the intended safety information to the nautical travelers on the waterways. Failing to convey the intended safety information to nautical travelers can have disastrous results including property damage, severe injury and even death.

As a vessel operator with the United States Customs and Border Protection, the inventor has witnessed accident scenes that resulted from nautical travelers failing to see navigation aids. After witnessing such horrors, the inventor realized that an improvement to the existing signage used to navigate the waterways is desperately needed.

Throughout his years as a vessel operator with the United States Customs and Border Protection, the inventor has navigated waterways at night using the "stand and shine" method. This method essentially consists of a procedure where a nautical traveler stands up while navigating his vessel and shines a light into the open waters and searches for reflective beacons to serve as indications of the navigable waterways. The problems with this method are obvious. Firstly, if the nautical traveler is alone, it is difficult to stand, shine, locate, and navigate the vessel all at the same time. Secondly, the reflective beacon only serves as a navigation aid as long as the light is shined in the beacons' direction and the moment the light is no longer shining on the reflective beacon, it effectively ceases to exist. As stated above, horrors may result if the nautical traveler cannot discern information from the navigational aids.

After years of navigating the waterways of the United States and its territories in conditions of limited visibility using the "stand and shine" method, the inventor realized that a navigation aid with both photoluminescent and enhanced light trapping qualities would enhance the safety of nautical travelers navigating the waterways of the United States and its territories.

The inventor realized that incorporating a photoluminescent element to the conventional Daybeacon would allow for enhanced visibility when a light source was directed towards the Daybeacon. The inventor also realized that incorporating a light wave redirecting means would allow for a broader range of light waves to be directed to the photoluminescent element, including light waves that were not directly shined on the Daybeacon.

As such, the need for the constant shining inherent in the "stand and shine" method as well as the associated dangers using the "stand and shine" would be greatly reduced because once a light source is directed towards the enhanced navigation aid or the light wave redirecting means, the light source would charge the photoluminescent element and the photoluminescent element of the current invention would remain illuminated thereby providing the nautical travelers with the much needed information from the navigation aid in a safer, longer lasting manner than that which the conventional Daybeacon can offer.

The inventor also envisioned an embodiment of the current invention that could be used to retrofit existing nautical signs.

An objective of the present invention is to provide a navigation aid to nautical travelers that is visible in less than ideal conditions.

Another objective of the present invention is to provide a navigation aid to nautical travelers that remains illuminated after the light source has been removed.

Another objective of the present invention is to provide a navigation aid to nautical travelers that can capture light waves from a light source that are not directly shined on the navigational aid.

Another objective of the present invention is to provide a photoluminescent enhancement that can be adapted to retrofit existing nautical signs.

Yet another objective of the present invention is to provide a navigation aid that reduces the dangers associated with the "stand and shine" method of navigating waterways in less than ideal visibility conditions.

Information relevant to attempts to address these objectives can be found in U.S. Pat. Nos. 5,243,457, 6,656,566, and 7,587,845. However, none of these references teaches a device with a light wave re-directing means to direct light waves that are not directly shined on the device and none of the references teaches a device that can be used to retrofit existing nautical sign.

For the foregoing reasons, there is a need for a nautical navigation aid with both a photoluminescent element and light wave re-directing means for improved photoluminescence to enhance the safety of nautical travelers on waterways in conditions where visibility is limited.

SUMMARY

The present invention is directed to a nautical navigation aid with both a photoluminescent element and a light wave re-directing means for improved photoluminescence to enhance the safety of nautical travelers on waterways in conditions where visibility is limited.

The navigation aid sign has a first rigid sheet member having an upper surface, a lower surface and a peripheral edge, a second rigid sheet member having an upper surface and a lower surface extending outward from the peripheral edge of the first rigid sheet member at a predetermined angle to a predetermined length, thereby defining an angled collar of the first rigid sheet member sized and configured to redirect light waves emanating from a light source, and a luminescent layer.

It is envisioned that an embodiment of the present invention might also include a means for retrofitting existing nautical navigation aids with a photoluminescent element and a light wave re-directing means for improved photoluminescence to enhance the safety of nautical travelers on waterways in conditions where visibility is limited. Such an embodiment would comprise essentially of a light wave redirecting collar sized and configured to mount to a standard day marker nautical sign.

It is envisioned that the retrofitable collar would comprise of a luminescent layer and extend outward from said nautical sign at a predetermined angle with respect to the nautical sign to a predetermined length with respect to the edge of the nautical sign. The retrofitable collar would also comprise of a mounting bracket for mounting the collar to an existing nautical sign.

DRAWINGS

These and other features, aspects, and advantages of the present invention will become better understood with regard to the following description, appended claims and drawings where:

FIG. 1. Shows one embodiment of a square shaped version of the nautical navigation aid;

FIG. 2 Shows a top view cross section of a square shaped version of the nautical navigation aid;

FIG. 3. Shows one embodiment of a triangular shaped version of the nautical navigation aid;

DESCRIPTION

Figure 2:
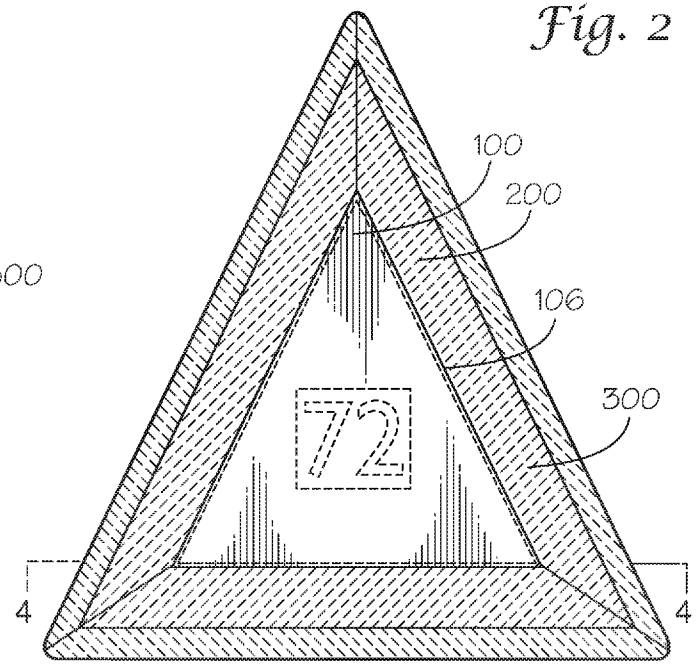
Figure 1:
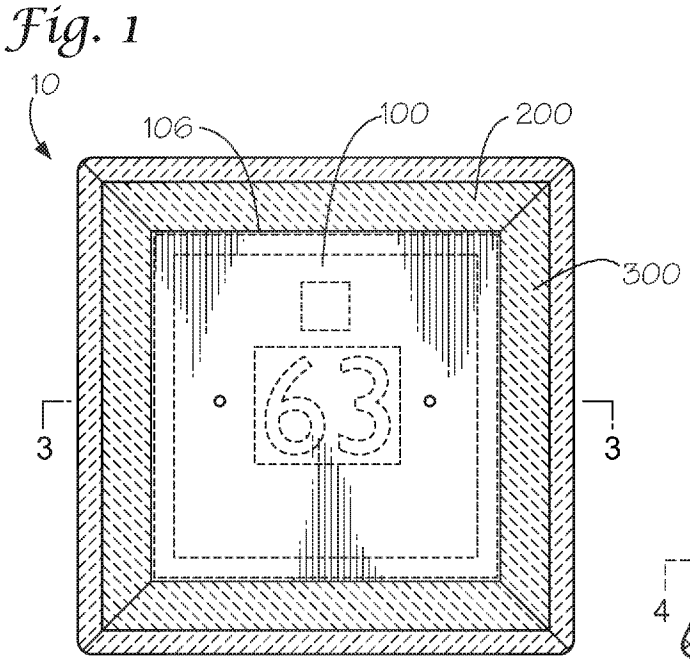
Figure 4:
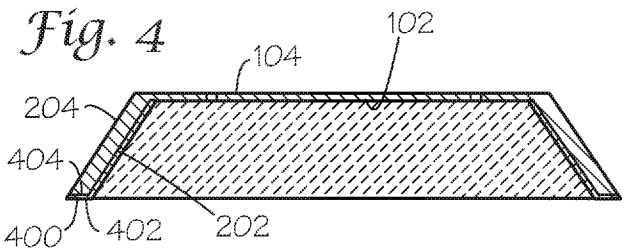
FIG. 4 Shows a top view cross section of a triangular shaped version of the nautical navigation aid.
Figure 3:
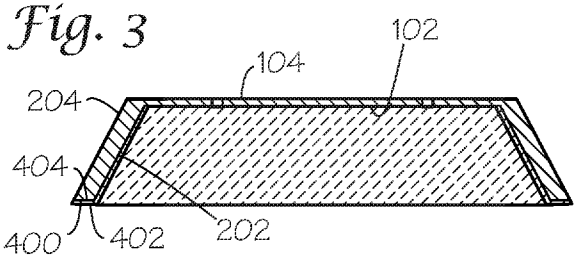

As shown in FIGS. 1-4, A nautical navigation aid with a photoluminescent element and a light wave redirection means 10 which comprises a first rigid sheet member 100 having an upper surface 102, a lower surface 104 and a peripheral edge 106; a second rigid sheet member 200 having an upper surface 202 and a lower surface 204 extending outward from the peripheral edge 106 of the first rigid sheet member 100 at a predetermined angle to a predetermined length, thereby defining an angled collar of the first rigid sheet member 100 sized and configured to redirect light waves emanating from a light source; and a luminescent layer 300.

In order to redirect a maximum amount of light-waves it is envisioned that the second rigid sheet member 200 will extend outward from the peripheral edge 106 of the first rigid sheet member 100 at an angle from about 30 degrees to about 45 degrees.

For most efficient redirecting it has been observed that the second rigid sheet member 200 should extend outward from about 2 inches to about 4 inches with respect to the peripheral edge 106 of the first rigid sheet member 100.

It is envisioned that the luminescent layer 300 might comprise an adhesive photoluminescent film 400 having an upper surface 402 and a lower surface 404, wherein the luminescent layer 300 is positioned such that the lower surface 404 of the photoluminescent film 400 contacts the upper surface 202 of the second rigid sheet member 200. It is further envisioned that the adhesive photoluminescent film 400 will be comprised of a material that can absorb photons from a light source and then remain glowing when the light source is removed. Compounds such as strontium oxide aluminate are known in the art and are known to be long-lived photoluminescent materials that are non-toxic and non-radioactive. Moreover, strontium oxide aluminates can obtain a full photoluminescent charge with as little as five (5) minutes exposure to a light source.

It is also envisioned that the luminescent layer 400 might be composed of a resin with photoluminescent qualities wherein the resin absorbs photons from a light source and remains glowing when the light source is removed.

In order to withstand the environmental conditions encountered in fresh water and salt water waterways, it is envisioned that the nautical navigation aid with a photoluminescent element and a light wave redirection means 10 will be composed of a salt, moisture, and ultraviolet ray resistant material, such as a high density polyethylene material, or a material with similar characteristics known in the art.

It is envisioned that the nautical navigation aid with a photoluminescent element and a light wave redirection means 10 will be used to replace the conventional Daymarker Daybeacons, and therefore it envisioned that the first rigid sheet member 100 and associated angled collar will be triangular or square in shape to correspond with the shapes of existing Daybeacons already known in the art.

Figure 5:
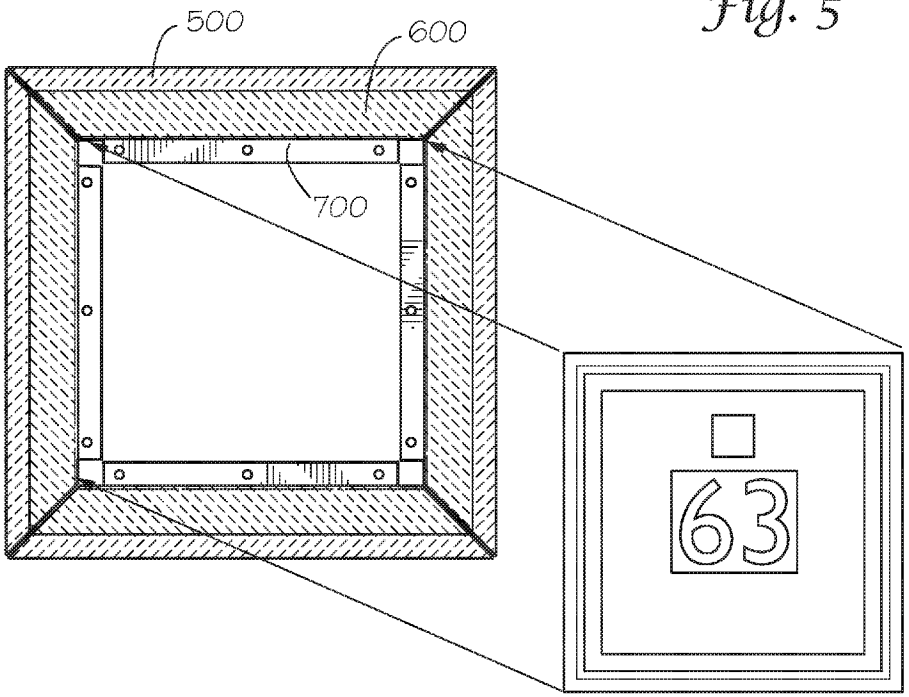
FIG. 5 Shows one embodiment of the light wave redirecting collar as it attaches to an existing standard day marker nautical sign.
Figure 6:
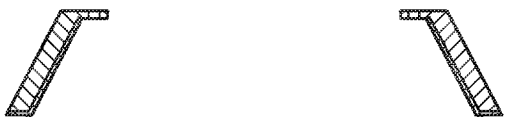
FIG. 6 Shows a top plan view of one embodiment of the present invention.
Figure 8:
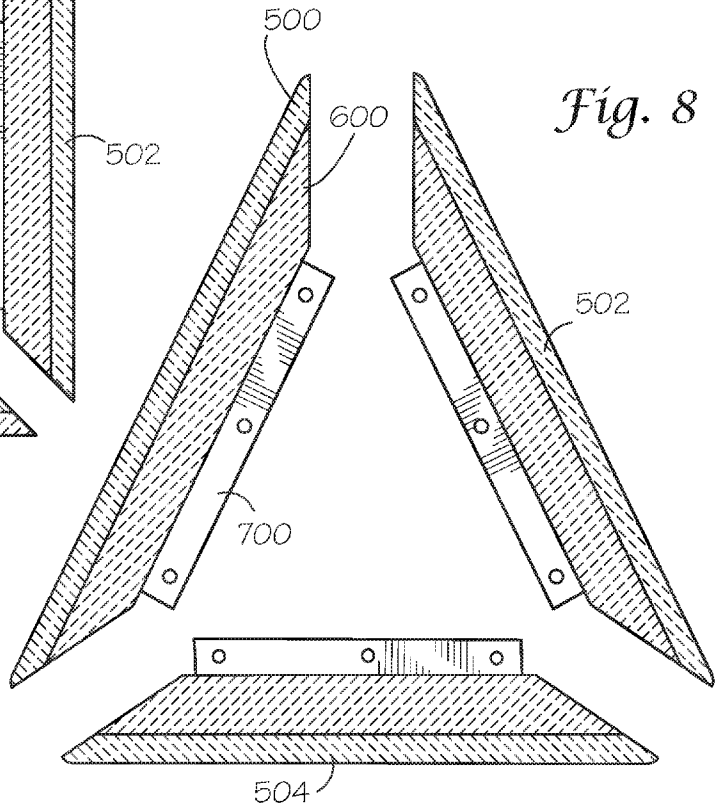
FIG. 8 Shows an exploded view of one embodiment of a triangular shaped light wave redirecting collar.
Figure 7:
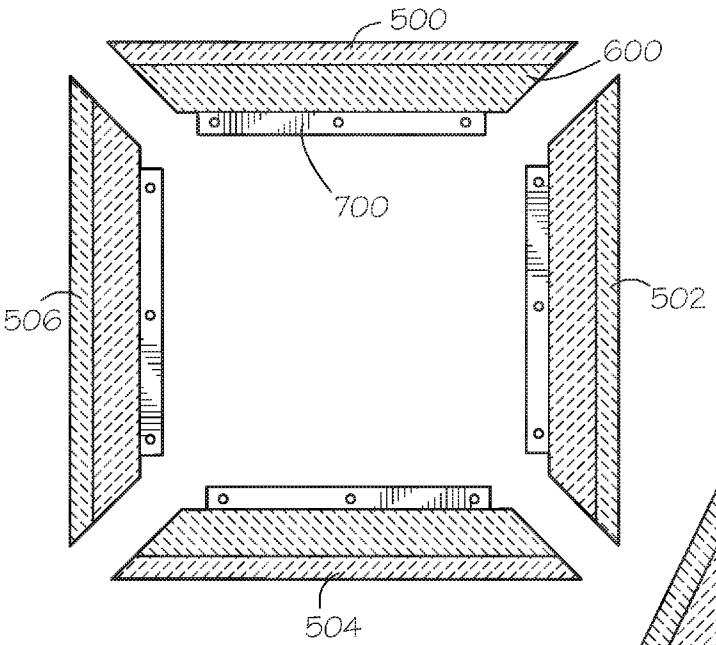
FIG. 7 Shows an exploded view of one embodiment of a square shaped light wave redirecting collar.

As seen in FIG. 5-8, it is envisioned that one embodiment of the nautical navigation aid with a photoluminescent element and a light wave redirection means 10 might comprise of a kit for retrofitting existing day marker nautical navigation aids.

It is envisioned that such a kit would comprise of a light wave redirecting collar 500 sized and configured to mount to a standard day marker nautical sign, a luminescent layer 600, and a mounting bracket 700 for mounting the collar to an existing nautical sign. See FIG. 5.

In one embodiment, the light wave redirecting collar 500 might comprise of a single continuous collar sized and configured to form a continuous angled border extending outward from the nautical sign.

In an alternative embodiment, it is envisioned that the light wave redirecting collar 500 might comprise of a plurality of subparts 502-506, sized and configured to form a continuous collar for the nautical sign that extends outward from the nautical sign.

It is envisioned that the luminescent layer 600 might comprise an adhesive photoluminescent film composed of a material that can absorb photons from a light source and then remain glowing when the light source is removed. Compounds such as strontium oxide aluminate are known in the art and are known to be long-lived photo-luminescent materials that are non-toxic and non-radioactive. Moreover, strontium oxide aluminates can obtain a full photoluminescent charge with as little as five (5) minutes exposure to a light source.

It is also envisioned that the luminescent layer 600 might be composed of a resin with photoluminescent qualities wherein the resin absorbs photons from a light source and remains glowing when the light source is removed.

In order to redirect a maximum amount of light-waves it is envisioned that the light wave redirecting collar 500 will extend outward from the nautical sign at an angle from about 30 degrees to about 45 degrees.

In order to withstand the environmental conditions encountered in fresh water and salt water waterways, it is envisioned that the light wave redirecting collar 500 will be composed of a salt, moisture, and ultraviolet ray resistant material, such as a high density polyethylene material, or a material with similar characteristics known in the art.

It is envisioned that the light wave redirecting collar 500 will be used to retrofit the conventional Daymarker Daybeacons known in the art, and therefore it envisioned that light wave redirecting collar 500 will be triangular or square in shape to correspond with the shapes of existing Daybeacons already known in the art.

An advantage of the present invention is that it provides a navigation aid to nautical travelers that is visible in less than ideal conditions.

Another advantage of the present invention is that it provides a navigation aid to nautical travelers that remains illuminated after the light source has been removed.

Another advantage of the present invention is that it provides a navigation aid to nautical travelers that can capture light waves from a light source that are not directly shined on the navigational aid.

Another advantage of the present invention is that it provides a photoluminescent enhancement that can be adapted to retrofit existing nautical signs.

Yet another advantage of the present invention is that it provides a navigation aid that reduces the dangers associated with the "stand and shine" method of navigating waterways in less than ideal visibility conditions.

Although the present invention has been described in considerable detail with reference to certain preferred versions thereof, other versions are possible. Therefore, the spirit and the scope of the claims should not be limited to the description of the preferred versions contained herein.

What is claimed is:

1. A nautical navigation aid with a photoluminescent element and a light wave redirection means which comprises: a first rigid sheet member having an upper surface, a lower surface and a peripheral edge, wherein the upper surface comprises of an indicia means; a second rigid sheet member having an upper surface and a lower surface extending outward and upward from the peripheral edge of the first rigid sheet member at a predetermined angle to a predetermined length, thereby defining an angled collar of the first rigid sheet member so that the first rigid sheet member and the second rigid sheet member extending outward and upward therefrom form an open dish shape of a predetermined depth sized and configured to redirect light waves emanating from a light source when said light source is an external light source directed towards the upper surface of the second rigid sheet member; and a luminescent layer, wherein the luminescent laver comprises an adhesive photoluminescent film having an upper surface and a lower surface, wherein the adhesive photoluminescent film absorbs photons from an external light source and remains glowing when the light source is removed, the luminescent laver is positioned such that the lower surface of the photoluminescent film contacts the upper surface of the second rigid sheet member.

2. The navigation aid of claim 1, wherein the adhesive photoluminescent film is comprised of strontium oxide aluminate.

3. The navigation aid of claim 1, wherein the second rigid sheet member extends outward and upward from the peripheral edge of the first rigid sheet member at an angle from about 30 degrees to about 45 degrees.

4. The navigation aid of claim 2, wherein the second rigid sheet member extend outward and upward from about 2 inches to about 4 inches with respect to the peripheral edge of the first rigid sheet member.

5. The navigation aid of claim 3, wherein the first rigid sheet member and the second rigid sheet member are composed of a salt and moisture resistant material.

6. The navigation aid of claim 4, wherein the first rigid sheet member and the second rigid sheet member are composed of an ultraviolet ray resistant material.

7. The navigation aid of claim 5, wherein the first rigid sheet member and the second rigid sheet member are composed of a high density polyethylene material.

8. The navigation aid of claim 1, wherein the luminescent layer is composed of a resin with photoluminescent qualities wherein the resin absorbs photons from a light source and remains glowing when the light source is removed.

9. A kit for retrofitting existing day marker nautical navigation aids which comprises: a light wave redirecting collar having and upper surface and a lower surface sized and configured to mount to a standard day marker nautical sign, the collar extends outward and upward from said nautical sign at a predetermined angle with respect to the nautical sign to a predetermined length with respect to the edge of the nautical sign so that the nautical sign and the light wave redirecting collar extending outward and upward therefrom form an open dish shape of a predetermined depth, the collar further comprises of a luminescent layer, wherein the luminescent laver further comprises of an adhesive photoluminescent film positioned such that the adhesive photoluminescent film is in contact with the upper surface of the light wave redirecting collar, the photo luminescent film absorbs photons from a light source and remains glowing when the light source is removed; and a mounting bracket for mounting the collar to an existing nautical sign, wherein the mounting bracket mounts to the peripheral edge of the nautical sign so that the light wave redirecting collar extends outward and upward from the edge of the nautical sign.

10. The kit of claim 9, wherein the luminescent layer comprises of a resin with photoluminescent qualities wherein the resin absorbs photons from a light source and remains glowing when the light source is removed.

11. The kit of claim 9, wherein the light wave redirecting collar comprises of a plurality of subparts, sized and configured to form a continuous collar for the nautical sign that extends outward and upward from the nautical sign.

12. The kit of claim 9, wherein the light wave redirecting collar comprises of a single continuous collar sized and configured to form a continuous angled border extending outward and upward from the nautical sign.

13. The kit of claim 9, wherein the light wave redirecting collar extends outward and upward from the nautical sign at an angle from about 30 degrees to about 45 degrees.

14. The kit of claim 9, wherein the light wave redirecting collar is triangular in shape and is sized and configured to mount to a standard triangular shaped day marker nautical sign, so that the light wave redirecting collar extends outward and upward from the nautical sign.

15. The kit of claim 9, wherein the light wave redirecting collar is square in shape and is sized and configured to mount to a standard square shaped day marker nautical sign, so that the light wave redirecting collar extends outward and upward from the nautical sign.

16. The kit of claim 9, wherein the light wave redirecting collar is composed of a high density polyethylene material.

* * * * *